United States Patent [19]

Ritter et al.

[11] Patent Number: 4,843,974

[45] **Date of Patent: * Jul. 4, 1989**

[54] HOPPER CAR WITH AUTOMATIC DISCHARGE DOOR MECHANISM

[75] Inventors: John A. Ritter, Cincinnati, Ohio; Keith J. Hallam, Roswell, Ga.

[73] Assignee: Thrall Car Manufacturing Company, Chicago Heights, Ill.

[ * ] Notice: The portion of the term of this patent subsequent to Aug. 30, 2005 has been disclaimed.

[21] Appl. No.: 154,090

[22] Filed: Feb. 9, 1988

Related U.S. Application Data

[63] Continuation-in-part of Ser. No. 57,111, Jun. 3, 1987, Pat. No. 4,766,820.

[51] Int. Cl.[4] ..... B61D 7/26

[52] U.S. Cl. ..... 105/240; 105/311.2; 105/313; 105/310

[58] Field of Search ..... 105/240, 286, 287, 288, 105/289, 290, 291, 310, 311.1, 311.2, 313; 49/291, 292; 92/14

[56] References Cited

U.S. PATENT DOCUMENTS

| | | | |
|---|---|---|---|
| 3,161,146 | 12/1964 | Lutts, Sr. et al. | 105/240 |
| 3,187,684 | 6/1965 | Ortner | 105/248 |
| 3,391,653 | 7/1968 | DeRidder | 105/253 |
| 3,596,608 | 8/1971 | Aquino et al. | 105/251 |
| 3,596,609 | 8/1971 | Ortner | 105/240 |
| 3,710,729 | 1/1973 | Schuller | 105/240 |
| 3,815,514 | 5/1974 | Heap | 105/304 X |
| 4,132,177 | 1/1979 | Funk | 105/310 |
| 4,508,037 | 4/1985 | Rousseau | 105/240 X |
| 4,601,244 | 7/1986 | Fischer | 105/240 |
| 4,688,488 | 8/1987 | Adams et al. | 105/253 |
| 4,741,274 | 5/1988 | Ferris et al. | 105/240 |

*Primary Examiner*—Dennis H. Pedder
*Assistant Examiner*—Frank Williams, Jr.
*Attorney, Agent, or Firm*—Marshall, O'Toole, Gerstein, Murray & Bicknell

[57] ABSTRACT

A railroad hopper car having bottom discharge doors, an elongated beam assembly along the bottom of the car, door operating levers to open and close the doors connected to the beam assembly and doors, and lost motion timing connections in the beam assembly which permits displacement of beam sections to open and close pairs or sets of doors in a sequential but substantially simultaneous and automatic order so ast to permit reduction of air pressure required to open the doors, or permit use of smaller diameter air cylinder, a pneumatic drive to move the beam in opposite directions to open and close the doors, and a secondary lock to maintain the beam stationary unless pneumatic pressure intentionally operates the pneumatic drive, with the lock being positioned to be readily seen when locked and safely operated if necessary from the wayside.

14 Claims, 9 Drawing Sheets

CLOSED

OPEN

HOPPER CAR WITH AUTOMATIC DISCHARGE DOOR MECHANISM

This application is a continuation-in-part of pending patent application Ser. No. 057,111 filed June 3, 1987 U.S. Pat. No. 4766820.

This invention relates to railroad hopper cars which carry aggregate lading, such as coal, stone and ores, which is unloaded by gravity flow through doors or gates in the bottom of the car body. More particularly, this invention is concerned with lost motion timing means in the operating beam of a quick opening and closing apparatus of hopper car doors, which can reduce the pneumatic pressure required to open the doors or permit use of a smaller diameter pneumatic cylinder, and a secondary lock mechanism which prevents the doors from opening accidentally, and desirably which can be positioned so as to be readily seen when locked and safely operated, if necessary, from the wayside.

BACKGROUND OF THE INVENTION

Railroads carry large amounts of aggregate lading such as coal, stone, ores and the like in open top hopper cars having gravity discharge openings in the car body bottom which are closed by openable doors or gates. Such doors were originally opened manually but, to reduce costs and speed lading discharge, various systems were developed to open the doors by mechanical means of different types. These discharge systems usually required that the car be stationary before the doors were opened. While such systems are highly useful for many shippers, they are still undesirably slow for unloading unit trains, such as trains of one hundred coal-loaded hopper cars. The unloading of trains of that magnitude is best effected by discharging the lading by opening the doors of a car in car-by-car sequence as the train continuously moves past the unloading site. The unloading of hopper cars in this manner requires that the door operating mechanism be safe and reliable and respond quickly to suitable signals to which the door operating mechanism responds. To prevent the door operating mechanism from opening accidentally a secondary lock is generally included. Such secondary locks are disclosed in U.S. Pat. Nos. 3,710,729 and 4,132,177. Also, U.S. Pat. Nos. 3,596,608 and 3,596,609 disclose door-actuating mechanisms.

Although the previously available apparatus for operating the hopper doors is useful for the intended purpose, alternative apparatus which operates the doors quickly and reliably and provides easy adjustment so that all doors can be tightly closed is desirable, as well as an improved secondary lock mechanism.

SUMMARY OF THE INVENTION

According to the invention a railroad hopper car is provided comprising an elongated car body having a plurality of laterally pivoted bottom discharge doors; a door opening and closing elongated beam assembly positioned longitudinal of and along the bottom portion of the car; a plurality of spaced apart door operating levers mounted on pivot means lateral to the car body along and to the bottom of the car; each door operating lever having at least first and second outwardly extending arm portions; a bar link pivotally connected at a first end to each door operating lever first arm portion and pivotally connected at a second end to one of the doors; the second arm portion of each door operating lever being pivotally connected to the elongated beam assembly; the second arm portions of the various levers being pivotally connected to the elongated beam assembly in spaced apart consecutive arrangement thereby defining beam sections between such pivotally connected lever arm portions; each beam section including a longitudinal lost motion timing means which permits displacement of the beam section for a short distance before it can apply a force in either direction to an adjacent beam section so that it can thereby apply sequential movement and force in one direction in tension and in the opposite direction in compression; and power means mounted on the car to drive the elongated beam in longitudinally opposite directions.

The lost motion timing means allows the doors to open sequentially so that the weight of the lading on a set of doors assists the air cylinder applied force required by the next operating beam segment to subsequently move the next door set of levers over center and open the doors. This, in effect, can reduce the air pressure required in the air cylinder to open the doors, or permit the air cylinder diameter to be reduced.

Each beam assembly section is desirably provided with means to change its length separate from the lost motion timing means.

Each bar link can include means to change its length so that the door to which it is connected can be adjusted to be closed tightly.

When the door is closed the bar link first end pivotal connection to the operating lever first arm desirably is at an over-center position with respect to a line through the pivotal connection of the bar link second end to the door and the pivotal connection of the lever arm to the car body thereby preventing the door from opening without a dynamic force being applied by the operating lever.

A plurality of the door operating levers can have a third outwardly extending arm; and a second bar link can be pivotally connected at a first end to the third arm portion and pivotally connected at a second end to one of the doors.

When the door is closed the second bar link first end pivotal connection to the operating lever third arm desirably is at an over-center position with respect to a line through the pivotal connection of the second bar link second end to the door and the pivotal connection of the lever arm to the car body thereby preventing the door from opening without a dynamic force being applied by the operating lever.

The means to change the length of a plurality of beam sections can include a clevis threaded into each of a plurality of the beam sections.

The means to change the length of a plurality of bar links can include a clevis threaded into each of a plurality of the bar links.

The lost motion timing means previously described can include a pin in one portion of the beam section and a slot in an adjoining beam portion in which the pin can slide a short distance.

Means to drive the beam in opposite directions to fully open and fully close all of the doors substantially simultaneously is also included. The drive means can include an air cylinder mounted on the car body; a double acting piston in the air cylinder having a connecting rod extending out of the cylinder; a drive lever pivotally mounted at the bottom of the car body; and a first end of the drive lever being pivotally connected to the connecting rod and a second end of the drive lever being pivotally connected to the elongated beam.

The car can include a secondary lock having a hook means pivotally mounted to the first end of the drive lever and having a hook at an end facing the air cylinder; and a hook catch on the cylinder lockably engageable with the hook when the elongated beam is displaced so the doors are closed.

Disengaging means can also be provided on the hook means and connecting rod to disengage the hook from the latch upon movement of the connecting rod outwardly from the cylinder before the drive lever moves. The disengaging means can include a cam and follower roller combination which lifts the hook out of locking engagement with the hook catch.

The connecting rod exterior of the cylinder can include a lost motion means whereby displacement of the connecting rod outwardly of the cylinder disengages the hook from the catch before applying driving force to the drive lever to move the beam to open the doors.

A second embodiment of a secondary lock provided by the invention has a hook pivotally mounted to the first end of the drive lever above the connecting rod and a hook at an end facing the air cylinder; a substantially stationary latch lockably engageable with the hook when the doors are closed; the means connecting the first end of the drive lever to the connecting rod including a pin and an inclined slot through which the pin extends laterally, with one of the pin and slot being in the connecting rod and the other of the pin and slot being in the drive lever; and means supporting the hook on the connecting rod when the hook and latch are in locking engagement; whereby when the connecting rod moves outwardly from a locked position with the latch engaged by the hook, the connecting rod first moves outwardly and upwardly and pivotally rotates the hook upwardly to lift the hook out of engagement with the latch before the drive lever effectively operates the drive mechanism to open the door.

The slot can be inclined at an angle of about 120° to 160° with respect to the connecting rod axis when the hook lockably engages the latch.

The cylinder can be mounted on the car body to pivot about a horizontal axis lateral to the car body.

The slot can be in the drive lever and the pin can be in the connecting rod and stationary relative to the connecting rod.

The slot length can be such that when the pin is in a lower portion of the slot the hook locks with the latch and when the pin reaches an upper portion of the slot the hook disengages from the latch.

DETAILED DESCRIPTION OF THE DRAWINGS

To the extent it is reasonable and practical the same or similar elements which appear in the various views of the drawings will be identified by the same numbers.

Figure 1:
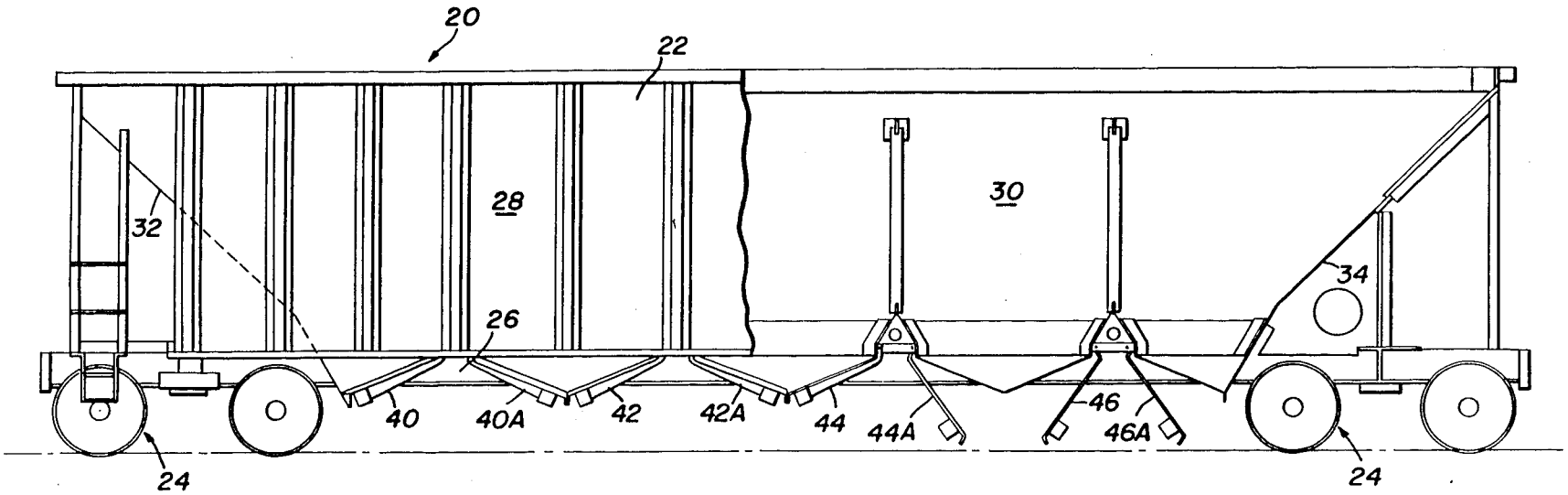
FIG. 1 is a side elevational view of a railroad car according to the invention having bottom discharge doors.

With reference to FIG. 1, the railroad car 20 has a body 22 supported at each end by conventional four wheel two axle trucks 24. The car body is supported by a center sill 26 which is supported at each end by one of the car trucks. The car body has opposing substantially vertical side walls 28,30 and sloping ends 32,34. The car is intended to transport coal and similar aggregate materials which can be readily and quickly emptied by gravity flow through bottom discharge openings having pivotal doors or gates located along the bottom of the car body.

The car 20, as shown in FIG. 1, has four pair of doors 40,40A; 42,42A; 44,44A and 46,46A. Each door is connected to the car body by a horizontal pivot pin or hinge 48 positioned to be substantially lateral to the car body and center sill 26. It is intended that the two doors of each pair operate in unison but rotate in opposite directions when being opened and in opposite directions when being closed. Additionally, for rapid discharge of the car lading, all doors are intended to be fully opened substantially simultaneously, and also subsequently fully closed substantially simultaneously. Accordingly, the car is illustrated in FIG. 1 with some doors closed and some doors open primarily to show the positions which the doors take with respect to the car body when opened and closed.

Figure 2:
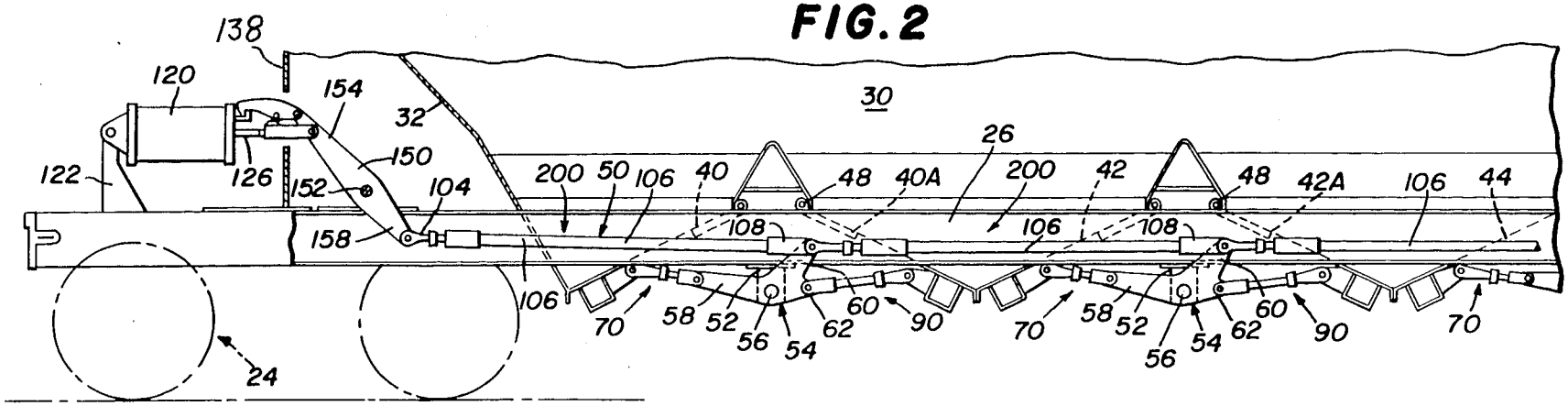
FIG. 2 is a side elevational view of the lower end portion of the railroad car shown in FIG. 1 with the side structure removed to expose the door operating mechanism.

Positioned in center sill 26 is a door opening and closing elongated beam assembly 50 (FIG. 2). Located in the center sill 26 are four longitudinally spaced apart door operating lever supports 52. A door operating lever 54 is pivotally mounted to each support 52 by a horizontal shaft 56 which is positioned lateral to the center sill 26.

Figure 5:
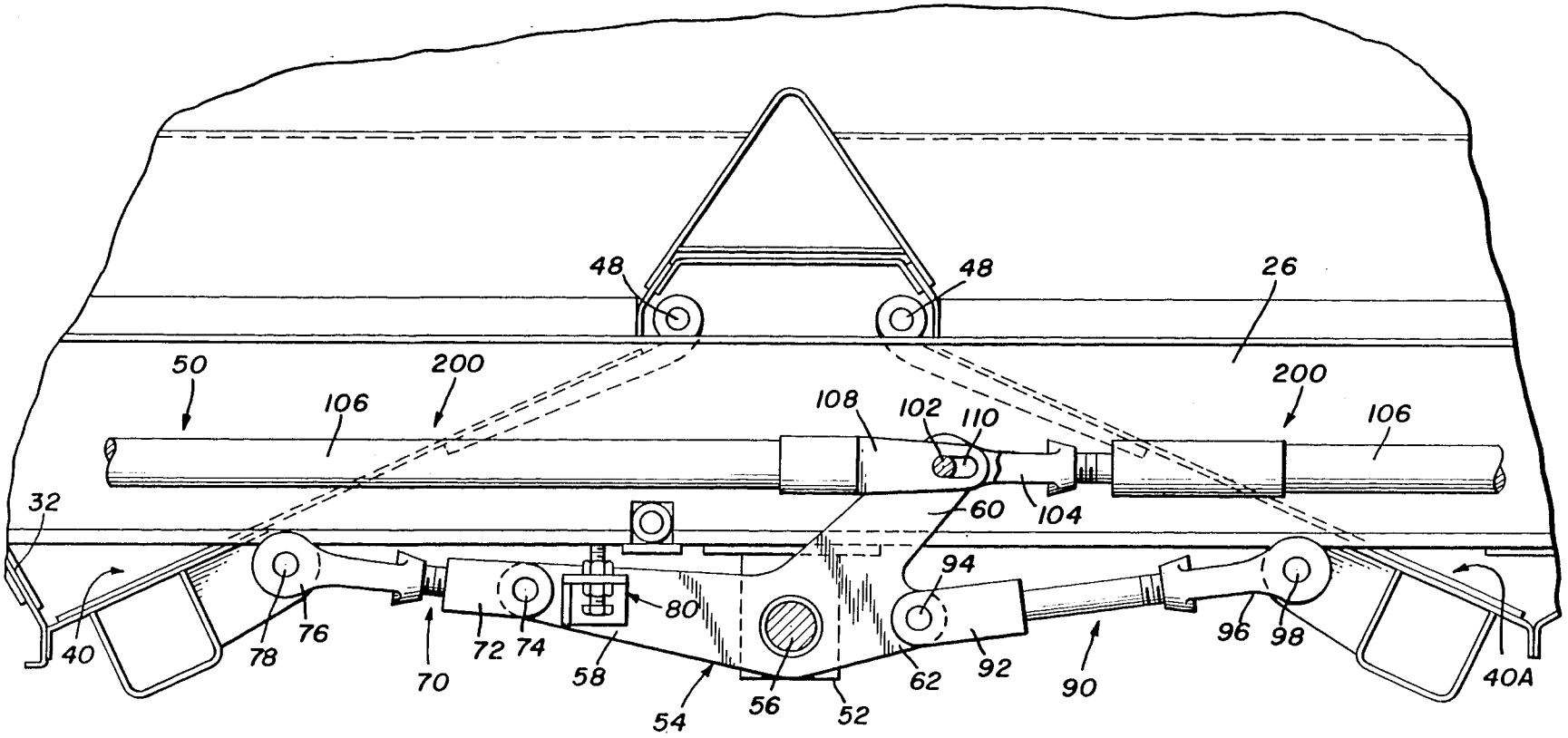
FIG. 5 is a side elevational view of a door operating lever showing it connected to two doors by bar links and to the elongated beam assembly.
Figure 6:
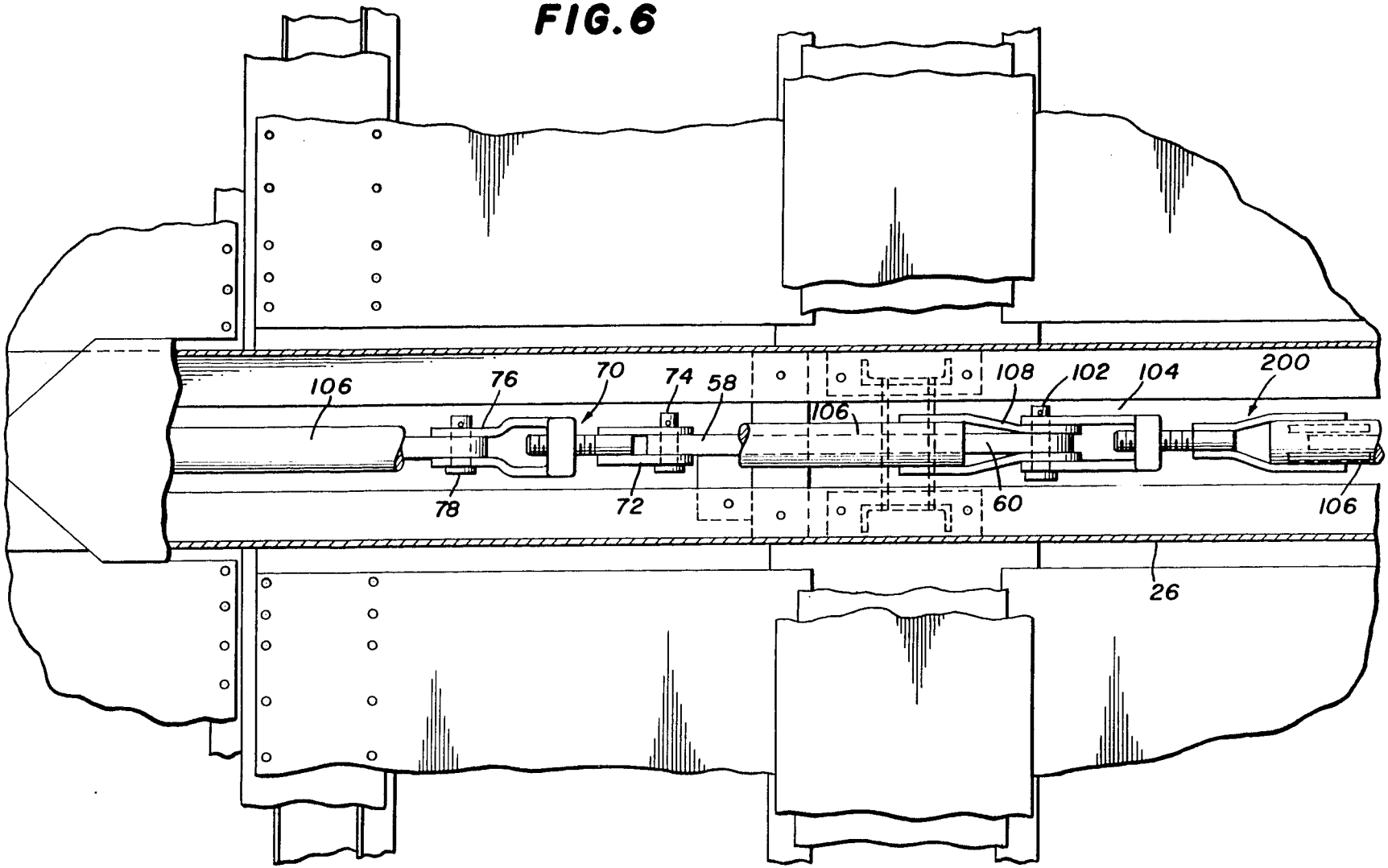
FIG. 6 is a plan view of the door operating elements illustrated by FIG. 5.

Each door operating lever 54 has a first arm 58, a second arm 60 and a third arm 62 (FIG. 5). A first bar link 70 is pivotally connected at a first end 72 to the door operating lever first arm 58 by pin 74, and at a second end 76 to a door 40, 42, 44 or 46 by pin 78. The length of bar link 70 is adjusted or changed by rotating end 76, which constitutes a clevis which is threadably included as part of the first bar link. In this way, the door 40 can be adjusted to be tightly closed to keep lading from flowing out. When the door 40 is properly closed, as well as doors 42, 44, 46, the pin 74 is located over-center or above a line through pins 56,78. The amount of over-center displacement is limited by adjustable stop 80 (FIG. 5). The described over-center arrangement prevents the pressure of the lading on the door 40, as well as doors 42, 44, 46, from rotating door operating lever 54 and thereby causing the door 40, and all the other doors, from opening.

A second bar link 90 is pivotally connected at a first end 92 by pin 94 to the door operating lever third arm 62, and at a second end 96 by pin 98 to a door 40A, 42A, 44A or 46A. The length of bar link 90 is adjusted or changed by rotating end 96, which constitutes a clevis which is threadably included as part of the second bar link 90.

The second arm 60 of each door operating lever 54 is pivotally connected to the elongated beam assembly 50 by a pin 102. The beam assembly 50 is made up of four beam sections 200 which are of similar construction although not of identical length. One beam section 200 extends from drive lever 150 to the second arm of the first door operating lever 54 to which it is connected by a pin 102 while each of the other three beam sections 200 extend between the second arms of adjacent levers 54 and are connected thereto by pins 102.

Each beam section 200, when viewed from left to right, has a clevis 104 threadable and thereby adjustably connected to the first or left end of bar 106. The length of the bar section is readily changed by this threadable connection. The second or right end of bar 106 has a shackle 108 with opposing slots 110 (FIG. 5) in which pin 102 fits so that relative sliding motion between the two is permitted for a short distance thereby providing a lost motion connection between the beam section, door operating arm 60 and the next adjacent beam section. Pin 102, however, fits snugly in holes in the arm 60 and clevis 104.

The purpose of the lost motion timing connections is to permit each pair of doors to begin to open before the next pair of doors in sequence begins to open to thereby apply maximum force to initial opening of each pair of doors rather than to have the maximum force applied divided equally to all door operating levers. The force of the unloading lading o a pair of doors will transmit a force to the elongated beam thereby assisting the force requirements to move the next door operating lever over center to open. This makes it possible to use a lower air pressure in the cylinder or to use a smaller diameter cylinder. The lost motion timing connections provide a similar advantage when the door closing motion starts. At the end of the closing cycle, each pin will be at the left end of the slot. Therefore all door operating levers 54 will go over center and lock simultaneously.

Figure 3:
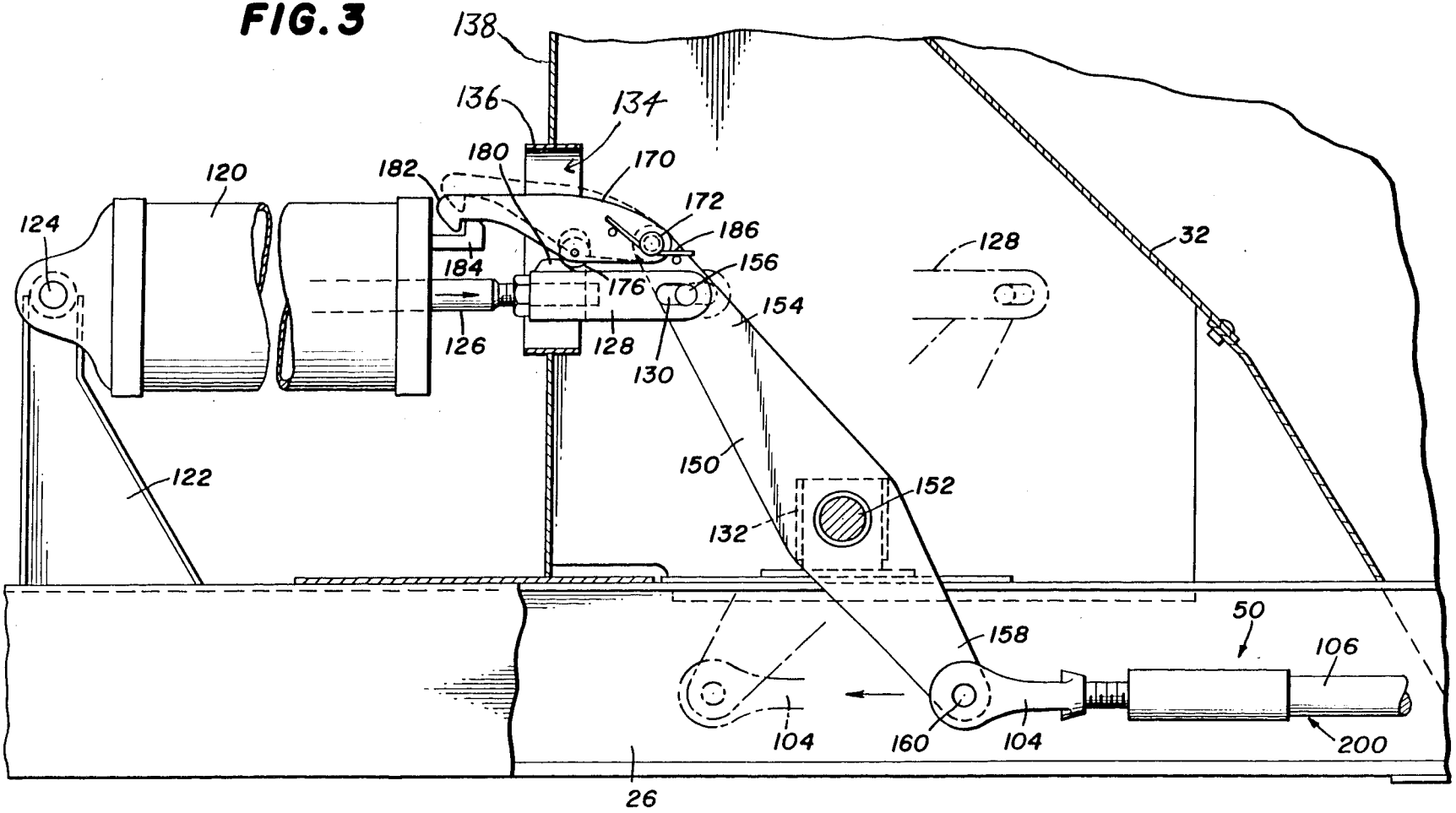
FIG. 3 is a side elevational view of the end of the railroad car shown in FIG. 2 showing the air cylinder and drive lever enlarged, and in position with the doors closed.
Figure 4:
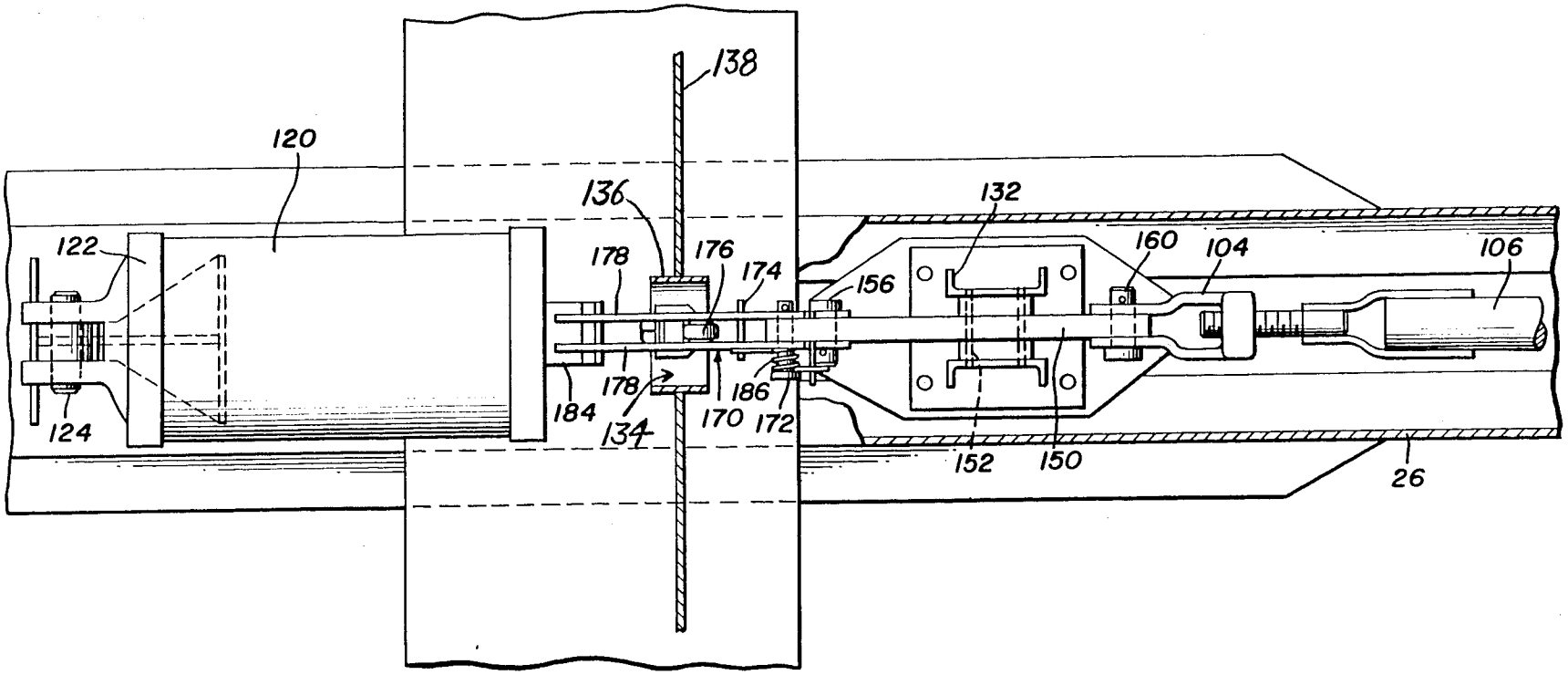
FIG. 4 is a plan view of the air cylinder and drive lever arrangement shown in FIG. 3.

As shown in FIGS. 3 to 7, air cylinder 120 is pivotally supported by bracket 122, mounted on the center sill 26, to rotate vertically about horizontal pin 124. A double acting piston, not shown, is positioned in air cylinder 120. Connecting rod 126 is connected to the piston and extends out of the end of the air cylinder 120. A clevis 128 is threadably connected to the end of connecting rod 126. The clevis 128 has a pair of opposing slots 130. The outer end of connecting rod 126 and clevis 128 project through an opening 134 defined by ring 136 in vertical bolster web or wall 138 (FIG. 3).

Figure 7:
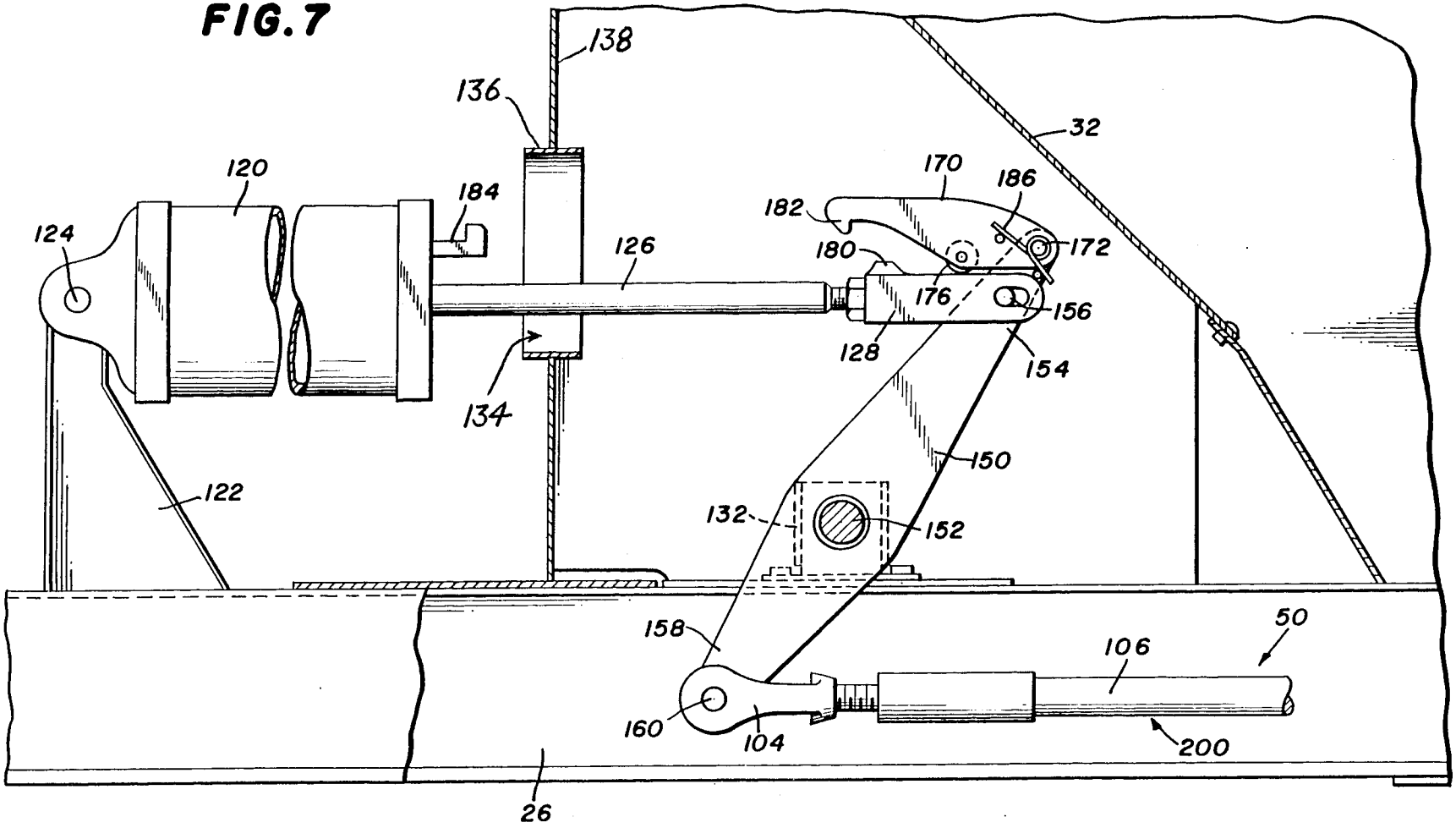
FIG. 7 is a side elevational view similar to FIG. 3 but illustrating the position taken by the drive lever when the doors are open.
Figure 8:
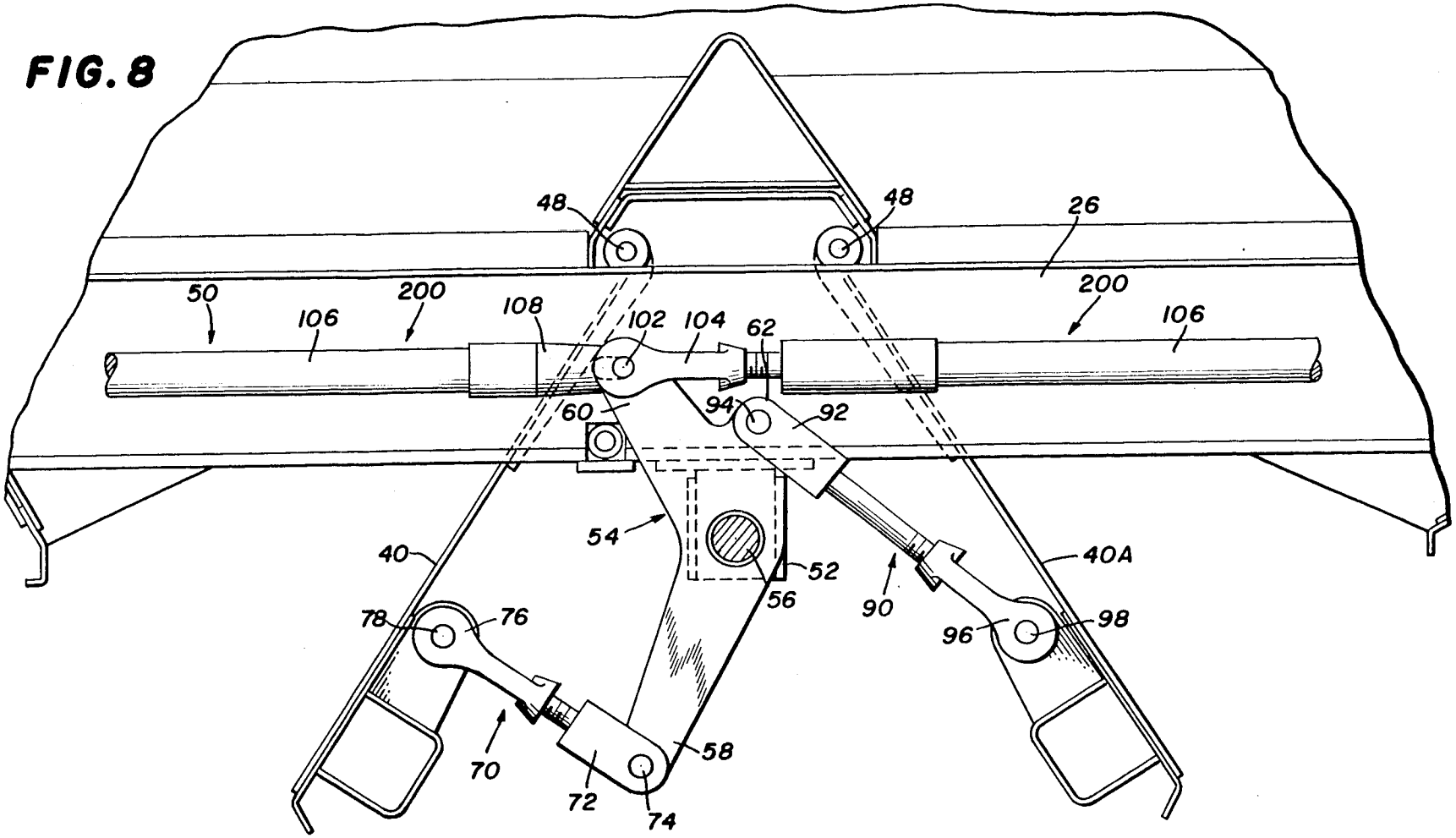
FIG. 8 is a side elevational view similar to FIG. 5 but with the doors opened by the door opening lever.

A bracket 132 is mounted on center sill 26 and pivotally supports drive lever 150 by means of horizontally and laterally positioned pin 152. The first or upper end 154 of the drive lever 150 is connected to the clevis 128 by pin 156 which fits in slots 130 thereby providing a lost motion connection by which the connecting rod moves a short distance before it applies a driving force to the drive lever 150. The second or lower end 158 of drive lever 150 is connected to clevis 104 at the left end of beam assembly 50 by a laterally positioned horizontal pin 160. FIG. 3 illustrates the position of the drive lever 150 with the doors in closed position while FIG. 7 illustrates the drive lever 150 with the doors in open position.

The outermost upper portion of drive lever 150 has a secondary look in the form of a hook 170 which is pivotally joined thereto by a horizontal lateral pin 172 (FIG. 3). Hook 170 is made of two spaced apart plates 178 which are maintained spaced apart by pin 174 and roller 176 which is mounted between the plates on an axle joined to the plates 178. The roller 176 is located along the bottom of hook 170 so as to project downwardly beyond the hook edge so that it can roll along the top of clevis 128 and the top of cam element 180 also located on the top of the clevis. The forward end of hook 170 has a downwardly extending nose 182 which engages with latch 184, mounted on the end of air cylinder 120, when the car doors are closed. The resulting locking arrangement prevents the car doors from opening accidentally even if the pin 74 is caused to move from over-center position to below-center position. The hook 170 is kept from being jarred out of locking position by a torsion spring 186 located on pin 172.

To open the car doors, air pressure is applied on the left side of the piston in air cylinder 120. This causes the connecting rod 126 to move outwardly a short distance equal to the lost motion clearance provided by slots 130 before any driving force is applied to drive lever 150. Any earlier application of driving force to the drive lever 150 would be restrained by the locking action of hook 170 with latch 184. The movement of the connecting rod 126 for the short distance of the lost motion causes the cam 180 to push against roller 176 and cause it to move upwardly for a height sufficient for the hook nose 182 to rise above the top of latch 184, thereby releasing the secondary lock. The air pressure in the cylinder continues to move the connecting rod 126 outwardly thereby causing the drive lever 150 to rotate from door closed position to door open position (FIGS. 3 and 7). As the drive lever 150 rotates it pulls on the beam assembly 50 causing each beam section 200 to move in sequential order for a distance equal to the lost motion provided in each beam section by slot 110. The unloading lading provides an assisting force to help open the doors as each beam section moves in sequence, as previously described herein. This makes it possible to lower the air pressure in the cylinder or to reduce the cylinder diameter.

An advantage of the secondary lock illustrated by FIGS. 2 and 3 is that the outer locking end of hook 170 is visible from outside the car when it engages the latch 184. As a result a trainman can readily and safely determine whether the hook 170 is in locked position or not without crawling under or in the car as is required with most other secondary locks. Additionally, even if there is a failure of car air pressure, the lock can be disengaged manually by inserting a pry bar under hook 170 and applying an upward force until nose 182 is freed from latch 184. Other means can then be used to open the doors.

After the car lading has been discharged, the car doors can be closed by venting air from the left side of the piston in air cylinder 120 and applying air pressure to the right side of the piston to cause the connecting rod 126 to move into the air cylinder. As the connecting rod moves to the left is described it pulls on the drive lever and causes it to rotate counterclockwise. This causes the application of a pushing or compressive force on beam assembly 50. Each of the beam sections 200 then moves to the right sequentially for a distance equal to the lost motion of slots 110 until all the lost motion has been eliminated. Then the entire beam assembly moves in a unitary manner so that all the doors close simultaneously. As the doors move into final closed position the hook 170 is automatically guided over latch 184 and into locking position with it.

Although the invention as described above in conjunction with the drawings utilizes a third arm 62 as part of the door operating lever 54, the third arm 62 could be eliminated if it is desired to eliminate use of every other door i.e., doors 40A, 42A, 44A and 46A. Eliminating doors, however, may require that the car body be modified internally so that lading can flow out readily through the remaining doors. Furthermore, one or more of the door operating levers 54 could be entirely eliminated. In still another embodiment, one or more first arms 58 could be eliminated as well as one or more third arms 62 in the event the number of car doors included in the car is reduced, such as to two, three, four or more doors up to less than eight doors.

Figure 9:
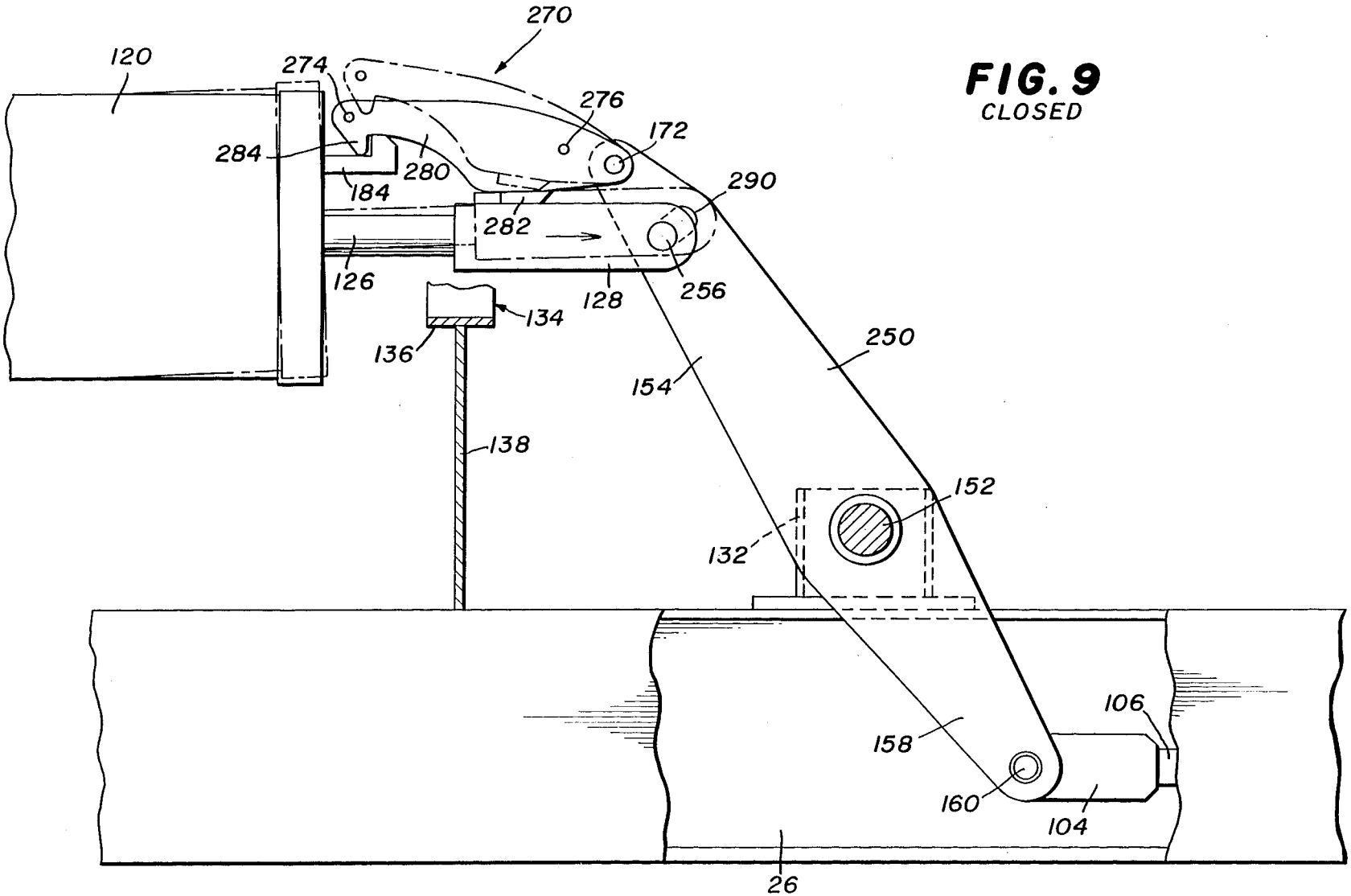
FIG. 9 is a side elevational view of a second embodiment of secondary lock shown in locked position in which the drive lever has a slot at the top engaged by a pin at the end of the connecting rod.
Figures 10, 11, 12:
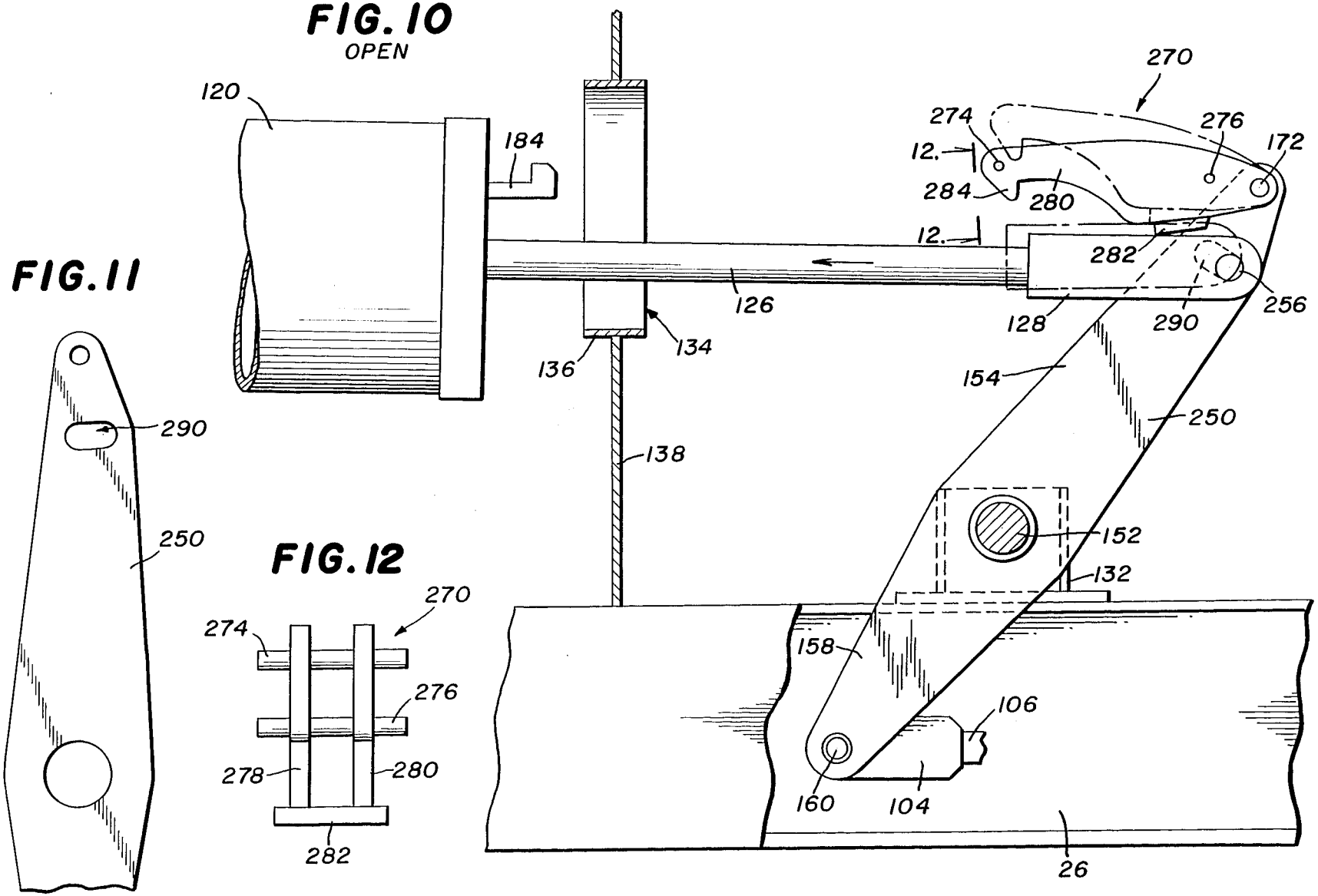
FIG. 10 is a side elevational view of the secondary lock, shown in FIG. 9, in open position.
FIG. 11 is a partial view of the drive lever used in the secondary lock of FIGS. 9 and 10 and shows the slot at the top of the drive lever.
FIG. 12 is an end view of the hook used in the secondary lock of FIGS. 9 to 11 taken along the line 12—12.

FIGS. 9 to 10 illustrate a second embodiment of secondary lock which can be used in place of the previously described lock without any changes in other elements of the car and door operating mechanism. This secondary lock, however, operates in a uniquely different manner than the previously described lock.

As shown in FIGS. 9 and 10, the drive lever 250 is mounted to pivot on horizontally and laterally positioned pin 152 mounted in bracket 132 on center sill 26. The first or upper end 154 of the drive lever 250 is connected to the clevis 128 on the connecting rod 126 by means of pin 256 in the clevis and a slot 290 in the drive lever. The pin 256 extends through slot 290. The second or lower end 158 of drive lever 250 is connected to clevis 104 at the left end of beam assembly 50 by laterally positioned horizontal pin 160.

Hook 270, constituting a secondary lock, is mounted to the outermost upper portion of drive lever 250 by a horizontal lateral pin 172. Hook 270 is made of two spaced apart plates 278,280 which are maintained spaced apart by pins 274,276 and bottom lateral plate 282 (FIG. 12). The bottom plate 282 is arranged so as to rest on top of clevis 128 at all times. The forward end of hook 270 has a downwardly extending nose 282 which engages latch 184, mounted on the end of air cylinder 120, when the car doors are closed. The resulting locking arrangement prevents the car doors from opening accidentally even if the pin 74 is caused to move from over-center position to below-center position.

When the secondary lock is in locked position as shown in FIG. 9, the slot 290 is at an angle of about 120° to 160° with respect to the axis of the connecting rod 126. Upon application of air pressure to cylinder 120 the connecting rod 126 moves outwardly to the right. This causes the pin 256 to slide upwardly to the top of slot 290 before movement of drive lever 250 occurs. The upward movement of pin 256 causes clevis 128 on the connecting rod to press upwardly against plate 282 on hook 270 thereby causing the hook to pivot upwardly on pin 172 to thereby displace hook nose 284 above latch 184. With the hook thereby displaced from locking position, further outward movement of connecting rod 126 causes the pin 256 to apply force to the end of slot 290 causing the drive lever to rotate clockwise to the position shown in FIG. 10 to cause the beam assembly 50 to move left and open the car doors. After the car is unloaded the application of air pressure to the other side of the piston in air cylinder 120 reverses rotation of the drive lever 250 until the doors are closed and hook 270 engages latch 184. During such reverse movement the pin 256 moves to the left end of the inclined slot 290. Just prior to the doors closing the inclined surfaces of the hook nose 284 contacts the inclined surface to latch 184. The hook nose 284 is raised upwardly by moving along the inclined surface of the latch until the hook 270 engages the latch 184 by dropping into place in locked position.

The secondary lock illustrated by FIGS. 9 to 12 makes use of outward and pivotal upward movement of the connecting rod to raise the hook and inward and pivotal downward movement of the connecting rod to lower the hook. The connecting rod pivotal movement is possible because the air cylinder is pivotally mounted on the car. In the first embodiment of secondary lock (FIGS. 3 and 7), only axial movement of the connecting rod is used to raise and lower the hook into and out of locking engagement with the latch 184.

Although the secondary lock illustrated by FIGS. 9 to 12 has the slot 290 in the drive lever 250, the same result can be achieved by placing the slot in the clevis 128 at the and of connecting rod 126 and by positioning pin 25 on the drive lever 250 at a suitable location.

Since the hook 270 has its forward end in public view and is observable from outside the car, a trainman can quickly see whether or not the hook lockably engages latch 184 before a loaded or unloaded car is moved. This is a safety feature possessed by both of the secondary locks provided by this invention. Even when pressurized air is unavailable to move the connecting rod 126, the hook 270 can be released from locking position by use of a pry bar pushed beneath the hook and then lifted. Other means can then be used to open the doors.

The foregoing detailed description has been given for clearness of understanding only, and no unnecessary limitations should be understood therefrom, as modifications will be obvious to those skilled in the art.

What is claimed is:

1. A railroad car having a plurality of bottom doors which are opened and closed by a drive mechanism powered by a pneumatic system which includes an air cylinder mounted on the car body and a double acting piston in the air cylinder having a connecting rod extending out of the cylinder:

a vertical drive lever, for operating the drive mechanism, pivotally mounted at the bottom of the car body:

means connecting a first end of the drive lever to the connecting rod and a second end of the drive lever being pivotally connected to the drive mechanism;

a secondary lock which when locked prevents outward movement of the connecting rod other than by pneumatic pressure applied to the piston;

the secondary lock including a hook pivotally mounted to the first end of the drive lever above the connecting rod and having a hook nose at an end facing the air cylinder;

a substantially stationary latch lockably engageable with the hook when the doors are closed;

the means connecting the first end of the drive lever to the connecting rod including a pin and an inclined slot through which the pin extends laterally, with one of the pin and slot being in the connecting rod and the other of the pin and slot being in the drive lever; and means supporting the hook on the connecting rod when the hook and latch are in locking engagement;

whereby when the connecting rod moves outwardly from a locked position with the latch engaged by the hook, the connecting rod first moves outwardly and pivotally upwardly and pivotally rotates the hook upwardly to lift the hook out of engagement with the latch before the drive lever effectively operates the drive mechanism to open the door.

2. A railroad car according to claim 1 in which the slot is inclined at an angle of about 120° to 160° with respect to the connecting rod axis when the hook lockably engages the latch.

3. A railroad car according to claim 1 in which the cylinder is mounted on the car body to pivot about a horizontal axis lateral to the car body.

4. A railroad car according to claim 1 in which the slot is in the drive lever and the pin is in the connecting rod and is stationary relative to the connecting rod.

5. A railroad car according to claim 4 in which the slot has a length such that when the pin is in a lower portion of the slot the hook locks with the latch and when the pin reaches an upper portion of the slot the hook disengages from the latch.

6. A railroad hopper car comprising:

an elongated car body having a plurality of laterally pivoted bottom discharged doors;

a door opening and closing elongated beam assembly positioned longitudinal of and along the bottom portion of the car;

a plurality of spaced apart door operating levers mounted on pivot means lateral to the car body along and to the bottom of the car;

each door operating lever having at least first and second outwardly extending arm portions;

a bar link pivotally connected to a first end to each door operating lever first arm portion and pivotally connected at a second end to one of the doors;

the second arm portion of each door operating lever being pivotally connected to the elongated beam assembly;

the second arm portions of the various levers being pivotally connected to the elongated beam assembly in spaced apart consecutive arrangement thereby defining beam sections between such pivotally connected lever arm portions;

each beam section including a longitudinal lost motion timing means which permits displacement of the beam section for a short distance before it can apply a force in either direction to an adjacent beam section so that it can thereby apply sequential movement and force to the beam section in one direction in tension and in the opposite direction in compression;

power means mounted on the car to drive the elongated beam in longitudinally opposite directions;

means to drive the beam in opposite directions to fully open and fully close all of the doors substantially simultaneously;

the drive means including an air cylinder mounted on the car body; a double acting piston in the air cylinder having a connecting rod extending out of the cylinder; a drive lever pivotally mounted at the bottom of the car body; and a first end of the drive lever being pivotally connected to the connecting rod and a second end of the drive lever being pivotally connected to the elongated beam; and a secondary lock having a hook means pivotally mounted to the first end of the drive lever and having a hook at an end facing the air cylinder; and a hook latch on the cylinder lockably engageable with the hook when the elongated beam is displaced so that the doors are closed.

7. A car according to claim 6 including:

disengaging means cooperatively and operatively positioned on the hook means and connecting rod which disengages the hook from the latch upon movement of the connecting rod outwardly from the cylinder before the drive lever moves.

8. A car according to claim 7 in which the disengaging means includes a cam and follower roller combination which lifts the hook out of the locking engagement with the hook latch.

9. A railroad car according to claim 8 in which the cam is a raised portion on the connecting rod and the follower roller is on the hook means and positioned to roll on the cam.

10. A car according to claim 7 in which the connecting rod exterior of the cylinder includes a lost motion means whereby displacement of the connecting rod outwardly of the cylinder disengages the hook from the latch before applying driving force to the drive lever to move the beam to the open doors.

11. In a railroad car having a plurality of bottom doors which are opened and closed by a drive lever powered by a pneumatic system which includes an air cylinder mounted on the car body and a double acting piston in the air cylinder having a connecting rod extending out of the cylinder and connected to the drive lever, the improvement comprising:

a vertical lateral bolster web on one end of the car separating the drive lever from the air cylinder;

an opening in the bolster web through which the connecting rod can extend;

a secondary lock which when locked prevents outward movement of the connecting rod from the cylinder other than by pneumatic pressure applied to the piston;

the secondary lock including a hook pivotally mounted to the first end of the drive lever and having a hook nose at an end facing the air cylinder;

a hook latch on the cylinder lockably engageable with the hook when the doors are closed; and when the doors are closed the hook projects through the bolster web opening and lockably engages the hook latch and the locking engagement of the hook and hook latch is observable from the outside of the car by a trainman alongside the car.

12. A railroad car having a plurality of bottom doors which are opened and closed by a drive mechanism powered by a pneumatic system which includes an air cylinder mounted on the car body and a double acting piston in the air cylinder having a connecting rod extending out of the cylinder;

a vertical drive lever, for operating the drive mechanism, pivotally mounted at the bottom of the car body;

means connecting a first end of the drive lever to the connecting rod and a second end of the drive lever being pivotally connected to the drive mechanism;

a secondary lock which when locked prevents outward movement of the connecting rod other than by pneumatic pressure applied to the piston;

the secondary lock including a hook pivotally mounted to the first end of the drive lever and having a hook nose at an end facing the air cylinder;

a substantially stationary latch lockably engageable with the hook when the doors are closed;

the means connecting the first end of the drive lever to the connecting rod including a pin and an inclined slot through which the pin extends laterally, with one of the pin and slot being in the connecting rod and the other of the pin and slot being in the drive lever;

means supporting the hook on the connecting rod when the hook and latch are in locking engagement; and whereby when the connecting rod moves outwardly from a locked position with the latch engaged by the hook, the connecting rod first moves outwardly and pivotally upwardly and pivotally rotates the hook upwardly to lift the hook out of engagement with the latch before the drive lever effectively operates the drive mechanism to open the door.

13. A railroad car according to claim 12 in which spring means biases the hook downwardly.

14. A railroad car according to claim 12 in which when the doors are closed the hook lockably engages the hook latch and the hook and hook latch are observable from outside of the car by a trainman alongside the car.

* * * * *

UNITED STATES PATENT AND TRADEMARK OFFICE

CERTIFICATE OF CORRECTION

PATENT NO. : 4,843,974

DATED : July 4, 1989

INVENTOR(S) : JOHN A. RITTER ET AL

It is certified that error appears in the above-identified patent and that said Letters Patent is hereby corrected as shown below:

Column 6, line 16, change "look" to -- lock --; column 8, line 17, change "to" to -- of --.

Signed and Sealed this

Twenty-seventh Day of February, 1990

*Attest:*

JEFFREY M. SAMUELS

*Attesting Officer* *Acting Commissioner of Patents and Trademarks*